United States Patent [19]

Siegal

[11] 4,419,931

[45] Dec. 13, 1983

[54] RECIPROCABLE IMPRINTING APPARATUS

[75] Inventor: Burton L. Siegal, Skokie, Ill.

[73] Assignee: Kiwi Coders Corporation, Wheeling, Ill.

[21] Appl. No.: 285,444

[22] Filed: Jul. 21, 1981

[51] Int. Cl.[3] ..... B41K 1/42

[52] U.S. Cl. ..... 101/333; 101/44

[58] Field of Search ..... 101/333, 334, 41, 42, 101/43, 44, 104, 105

[56] References Cited

U.S. PATENT DOCUMENTS

| | | | |
|---|---|---|---|
| 2,505,900 | 5/1950 | Knitter | 101/41 |
| 3,005,405 | 10/1961 | Schubert et al. | 101/41 |
| 3,168,863 | 2/1965 | McRae | 101/43 |
| 3,174,426 | 3/1965 | Boekeloo et al. | 101/42 |
| 3,599,566 | 8/1971 | Fish | 101/333 |
| 3,804,016 | 4/1974 | Marozzi et al. | 101/333 |
| 4,015,525 | 4/1977 | Shenoha | 101/333 |

*Primary Examiner*—Clifford D. Crowder

*Attorney, Agent, or Firm*—Silverman, Cass & Singer, Ltd.

[57] ABSTRACT

An article marking apparatus of the reciprocable impact type wherein an imprinting head is driven from a rest condition sealably engaged with an inking cartridge assembly through a 90° rotation to impact upon the surface of a passing article whereby to imprint indicia information thereon represented by printing type font carried by said imprinting head. The imprinting head is pivotally coupled to a pneumatic drive device by a linkage assembly including a drive link. The imprinting head mounts a shaft having freely rotatable bushings at its opposite ends. Opposite cam slots are provided formed in the housing for receipt of the bushings for guilding the imprinting head along a predetermined path for translating said head through an imprinting stroke and return while the head is rotated at constant angular rotational accelleration. The peak of the rate of angular rotation of the head occurs midway in the stroke with the head assuming a motion to the terminus. When the terminus of the stroke is reached, the type holder continues inertially to extend from the head to impact gently upon the surface to be imprinted. The return stroke is initiated after impact. The drive link is mounted directly to the plunger of the pneumatic drive; the plunger is mounted on an eccentric pivot axis. The said eccentric axis can be changed to provide a vernier adjustment of the stroke limits.

9 Claims, 4 Drawing Figures

RECIPROCABLE IMPRINTING APPARATUS

CROSS-REFERENCE TO RELATED APPLICATIONS

This application describes an improvement over the reciprocable type article imprinting apparatus, disclosed in Ser. No. 200,913, now U.S. Pat. No. 4,365,554, filed Oct. 27, 1980, by applicant and Jay S. Waxman, and owned by the assignee hereof. Reference may be made to the disclosure of said application, which is incorporated by reference herein, for details of common subject matter.

BACKGROUND OF THE INVENTION

This invention relates generally to article imprinting apparatus for imprinting information upon packages, cartons and the like as they travel successively spaced along the reach of a conveyor. Moreover, there is provided an improved reciprocable imprinting apparatus which is durable and versatile, less costly to fabricate, assemble and maintain than prior devices, which enables the employment of pre-inked ink cartridges, which markededly increases the useful life thereof by having means for effecting sealing off of the cartridges during all but the actual imprinting stroke of the apparatus.

In particular, the apparatus provided by the invention includes an imprinting head carrying a biased releasably mounted type holder on which type font can be secured. An effective seal is established between the imprinting head and a disposable inking cartridge to prevent evaporative loss from the cartridge, except during the momentary translation of the head along a path leading to an angularly displaced imprinting location whereat the imprinting is performed. Drive means including a drive linkage, and cam and follower guide means are provided to direct the imprinting head along said path in imprinting and return strokes wherein the head is driven at a constant angular rotational accelleration to midstroke whereat a constant rate of decelleration is effected until the end of the stroke.

Known devices capable of imprinting information upon surfaces of packages, cartons and the like conveyed spaced along a given path along the reach of the conveyor generally are of complex construction with accompanying expense of manufacture, fabrication, assembly and maintenance. Two major types of devices are employed in imprinting indicia on packages and the like. One type of device includes a rotary imprinting wheel on which the type font can be mounted for repeated inking by rotary ink transfer means to which ink is supplied from a source thereof, the imprinting wheel intercepting the article to be imprinted. The second major type of imprinting apparatus involves stamping or impacting inked type face means repeatedly upon successively arriving articles. The invention concerns the latter type.

The type face means are supplied with ink by impacting upon an ink saturated pad or the like, usually supplied by some storage means such as a cartridge or the like, which include an ink impervious body having an access window.

The invention herein is concerned with the repeatable impact type imprinting apparatus which involves substantial frequency of required maintenance, and particularly the short life of the inking means employed. Frequent and time-consuming ink cartridge replacement is the rule. One reason for such short cartridge useful life may be attributed to the unusually fast drying character of the ink employed. These highly volatile inks evaporate rapidly, usually depleting the ink pad after only a short time or leaving an inking surface which quickly becomes hard and dry, preventing the normal capillarity effect to resupply the surface of the pad. This phenomenon is encountered where the ink supply takes the form of an ink-saturated absorbent pad disposed within a disposable cartridge having access window means to accommodate the printing head. Often, the skin formed by solvent evaporation is hard whereby ink is unevenly applied to the type font, or at least, is insufficient to effect uniform marking of the package, etc.

During the course of the operation of the imprinting apparatus, the imprinting head is disposed substantially longer at the rest condition, engaged against the inking pad surface. The translation of the imprinting head to the imprinting location and application of the imprint occupies minimal time and requires little exposure of the inking pad. Nevertheless, substantial reduction of the effectiveness of the inking means results since evaporation, etc. occurs while the type holder (carried by the imprinting head) is engaged with the inking pad of the ink storing cartridge.

Seals have been attempted with mixed results. Some attempts have interfered with the inking of the type font while others have been ineffective, failing to establish an effective seal.

It should be noted that the ink-saturated pad is generally resilient because of its saturated condition and the character of the ink absorbent material used to form the pad. The area of engagement of the imprinting head as well as the surface of the head engaging the pad is sometimes so resilient as to fail to establish an effective seal. The type holder seated on the imprinting head and effectively constituting same also is not well suited to make a proper seal with the ink-saturated pad or its surrounding border defining lining member, where provided. Accordingly, rapid evaporation of the fast drying ink still materially reduces the useful life of available cartridges requiring removal of the exhausted cartridge and replacement with a fresh cartridge. Often such premature disabling of the ink supply cartridges occurs many times during a normal (average) imprinting run regardless of the number of articles imprinted.

Another problem encountered with the employment of imprinting apparatus of the type described hereinabove involves the formation of a hard skin formed on the pad as a result of evaporation. The skin prevents transfer of ink from the pad, even though there is substantial ink remainent within the impregnated storing pad. This results in premature removal and replacement of the cartridge long prior to depletion of the ink stored therein.

Still another difficulty encountered with an imprinting apparatus such as described above involves the means employed to effect the translation of the imprinting head to the imprinting position and return. It is known to employ pivotable arms and the like to mount an imprinting head for repeated movement. Ordinarily, these arms are coupled to a source of dynamic power, such as a fluid operated hydraulic or pneumatic system coupled through a signalling device to a drive arms, in turn secured to an imprinting head and/or to the mounting therefor. Known drives cause the imprinting head to be translated from its rest condition to its angularly displaced position at the imprinting location, so that the imprinting head assumes an orientation with its center line perpendicular to the surface upon which imprinting is to be effected.

It is difficult to maintain the head in the proper path to prevent deviation therefrom during translation to and return from the imprinting location. There has been considerable difficulty in achieving the proper orientation of said imprinting head as well as in controlling the contact pressure exerted by the imprinting head both upon the package surface and upon the inksaturated pad. Shaking and misalignment have been experienced. Where the contact pressure at impact is too great, smearing and/or other blurring of the imprint would be encountered. Often the imprinting head would be misoriented during its imprinting contact with the package surface, resulting in partial imprints, or imprints carrying too much ink, notwithstanding the fast drying nature of the inks employed. The return stroke often strongly impacts in the relatively soft, yieldable surface of the ink-saturated pad whereby to cause splashing of ink fouling the apparatus, the imprinting head and carrier therefor, and often causing ink to be thrown outward, fouling the ambient surroundings.

The imprinting apparatus proposed in the referenced application has been effective to prevent the above adverse occurances and includes, as a part thereof, means to prevent evaporative loss by establishing an effective sealed engagement between the ink cartridge and the printing head during all but the actual imprinting. Additionally, the impact or contact pressure exercised by the imprinting head (the type face carried thereby) upon the saturated inking pad is controlled so that one need not be forced to elect between a contact pressure at impact sufficient to assure proper inking and reduction of contact pressure to prevent splashing of ink.

The apparatus therein also provided for control of the quantity of ink applied to the type font during each inking step, to alleviate the problem of excess ink applied to the type which results in smearing of the imprint and the problem of unsatisfactory faint imprints resulting from insufficient application of ink. Additionally, the force of impact upon the surface to be imprinted is carefully controlled to assure proper clear and sharply defined imprints without requiring controls.

The translation of the imprinting head between the pair of angularly displaced operating positions was effected by mechanisms which are relatively simple in construction and are effective to assure proper orientation of the type carried by the imprinting head both on the ink saturated pad during the rest condition, and during the time period when momentarily displaced therefrom to effect application of the imprint. Facility in servicing the imprinting apparatus also was a desirable feature not readily available with earlier imprinting devices of this type. Advantages of the removability both of the inking cartridge and of the type holder for replacement, change or reorientation were achieved which is a strong factor in employing the apparatus of said referenced application.

The imprinting apparatus described in said referenced application included an imprinting head carrying type font seated upon a support member and arranged for displacement between a pair of angularly spaced positions (by a signal controlled drive device, either fluid operated or electrically operated). The imprinting head thus intermittently was displaced form a rest position to an imprinting position at which the type holder momentarily contacts the surface to be imprinted. In the rest position, the head is in sealed engagement with an apertured closure of a pre-inked ink storing cartridge so as to seal the cartridge while the imprinting head is coated with ink from an ink-saturated pad within the cartridge. The cartridge was yieldably held in position in a mounting disposed in said apparatus so that a desired contact pressure between the imprinting head in its rest position and the saturated pad is maintained so as to effect efficient ink transfer to the imprinting head.

The pre-inked cartridge includes an ink saturated pad seated within an ink impervious housing, usually formed of plastic material. Access is enabled to one side of the cartridge by removal of cover piece leaving an ink impervious border portion surrounding the window exposed when the cover is removed. The imprinting head seats on the inner rim of a disk-shaped mask seated on the ink cartridge, said mask itself being seated upon a plastic border portion, when the head is at the rest position to effect a seal therebetween to control thereby the impact of the imprinting head upon said ink-saturated pad reducing the contact pressure at impact which otherwise would cause splash and further, to prevent excessive impact and contact pressure between the returning imprinting head and the saturated ink pad. Means also are provided to facilitate removal and/or replacement of the type holder of the imprinting head without causing undue downtime of the apparatus. The control of contact pressure is effective for both the inking and the imprinting states of the imprinting head. Means also to cushion the impact of the imprinting head are provided so that the imprinting head effects a soft impact with the surface of the ink-saturated pad and with the surface of the article to be imprinted, respectively.

The path taken by the imprinting head of said referenced application was controlled by a pair of linkages secured to the head, including a direct driven link pair and a follower or idler linkage pair. The imprinting head at its rest or loading condition is oriented at a ninety degree angle relative horizontal. The head is driven through a path toward an offset printing location angularly rotating through 90′ in the course of its simultaneous movement to its imprinting location. The idler link provided by the referenced structure follows a path whereby the angular rate of rotation decreases until the mid point of the path is reached and then increases until the terminus of its printing stroke is reached. The type holder is spring biased so that it is inertially driven outward of the head on the sudden cessation of movement of the imprinting head at the imprinting terminus of said path.

Occasionally, the movement of the imprinting head through the imprinting stroke angularly is misdirected so that the orientation of the type holder may be misoriented at the impact location. The head also may be held up at the mid-point of travel, misoriented, inverted, or simply stuck thereat as the rate of travel and the angular rotation, ie., the whip—is at its least. A resilient bumper is suggested in the referenced application to aid in guiding the rotating imprinting head in following the proper path.

While normally the operation of the drive and guide means provided by the referenced apparatus is successful, improvement of its apparatus and reliability is desirable but without any loss in advantage gained by said apparatus over other apparatus.

Another improvement desired over the referenced apparatus is to provide for adjustment of the imprint distance relative to article being imprinted so that the installation (mounting) of the imprinting apparatus need not be changed (raised or lowered) to compensate for small changes in height of the articles.

SUMMARY OF THE INVENTION

A reciprocable impact type imprinting apparatus includes an imprinting head and means to translate said head between a rest or loading condition to an angularly displaced imprinting condition and return. The translation is effected by a drive linkage coupled to drive means and guided by cam roller follower means seated and traveling within cam slot means by which constant angular accelleration is achieved, the rate of angular rotation at midpath being the greatest while the ends of the strokes are reached at minimum rate.

Means providing vernier adjustment of the length of the strokes are provided whereby the location of the impact point may be selectively fine adjusted without change in mounting of the apparatus.

DESCRIPTION OF PREFERRED EMBODIMENTS

Figure 1:
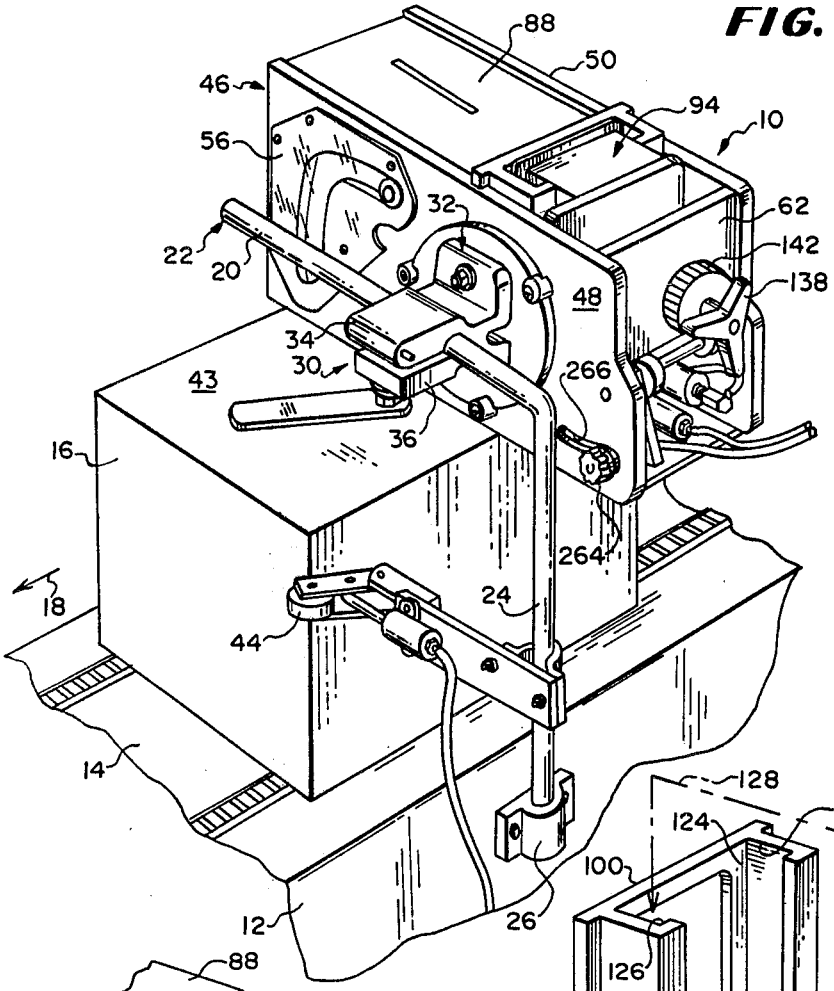
FIG. 1 is a top perspective view of the article imprinting apparatus constructed in accordance with the invention and viewed installed on a conveyor frame in proximity to articles to be imprinted.

The invention herein provides a reciprocable impact type imprinting apparatus for applying imprint information upon a facing surface of packages, cartons, and the like conveyed spaced along a given path along the reach of a conveyor.

An imprinting head is positioned adjustably for intermittent translation between a rest condition sealingly engaged with the surface of an ink saturated medium in the form of a removably pre-inked ink storing cartridge and an angularly spaced imprinting position effected by a signal-controlled pressurized fluid operated drive system so that the imprinting head contacts the surface of the article to be imprinted.

The imprinting head is translated between these two positions by a drive linkage coupled to said fluid operated system and is guided by cam roller means functioning as a follower seated within cam means in the form of opposite slots defining the path along which the imprinting head is driven effecting constant angular accelleration to a maximum at the midpath and constant decelleration to a cessation of travel at the terminus of the imprinting stroke. The imprinting head is journalled on a shaft, the opposite ends of which carry the cam roller means. At the midpath, the imprinting head is traveling at its maximum angular rate and following the substantially right angle turn in the direction of the path taken by said slots, the imprinting head whips about the corner with its center line assuming a vertically normal orientation. Ninety degrees from its orientation in the rest condition with the enlarged head end facing the imprinting location. Note, that during the imprinting stroke the movement of the link is in a clockwise direction while the imprinting head rotates in a counter clockwise direction (viewed in FIG. 4).

The enlarged head includes an outwardly opening socket which includes the cavity for receiving the type holder mounted therein to enable limited inertial outward movement thereof. The type holder includes a base lock arrangement for securely holding type elements therein. A resilient gasket is secured, preferably by adhesive material, on the outer rim of the type holder for cooperating with sealing means surrounding the ink-saturated surface of the inking cartridge whereby a sealed condition is established during the period while the imprinting head is at rest position. The ink cartridge is seated within the apparatus. Means adjustably to lock the same therewithin and to exert a controlled force thereupon are provided.

The type holder is biased, preferably spring biased, to enable the type holder to fly out inertially from the imprinting head when the latter is stopped in its translation along the defined path to the imprinting condition to impact gently upon the surface to be imprinted. The type holder impacts upon the ink cartridge assembly at the rest condition after the return stroke since the head is intercepted before actually reaching the end of the normal extent of the full return stroke. The type font elements carried by the base lock means provided on the type holder extend a fraction outward of the sealing surface so that the end surfaces of the type font are coated with sufficient ink yet overloading of the type font with ink is prevented. In addition, splashing of ink upon impact is materially reduced, if not prevented altogether.

At the terminus of the imprinting stroke, the distance of maximum extension of the type holder or point of impact upon the article to be imprinted is capable of adjustment by limiting the length of the imprinting stroke, and, concomitant therewith, the return stroke. The limitation may be varied within adjustable limits as shall be described later.

Referring now to the drawings for details, the article imprinting apparatus constructed in accordance with the invention herein is designated generally by reference character 10 and is illustrated in FIG. 1, mounted on the frame 12 of a conveyor 14 along which articles 16 travel in a direction indicated by the arrow 18 past said apparatus 10 to enable single imprinting of each with informational indicia.

The apparatus 10 is illustrated mounted on the horizontally oriented arm 20 of bent rod 22, with the vertically oriented arm 24 secured to the frame 12 by clamp 26. Releasable clamp 30 effects the securement of the apparatus 10 to the arm 20 in operating condition and includes a clamping bracket 32 having a pair of generally parallel spaced arms 34 and 36, each including arcuate facing portions 38 to receive the rod arm 20 therebetween. The arms 34 and 36 are capable of being urged together by a capped bolt 40. A captive flat wrench 42 is retained on the capped bolt 40 by washer 40' and snap ring 40'' secured inward of the capped bolt 40. The wrench 42 functions as a lever which can be utilized to release the rod arm 20 or to clamp same at a location assuring proper location of apparatus 10 for application of an imprint upon the surface 43 of the article 16.

The desired height relative to the conveyor at which the apparatus 10 is disposed is fixed on installation by manipulation of the relationship of the rod arm 22 and clamp 26. Rod arm 22 also can carry an actuating lever 44 extending into the path of the article 16 in position to be tripped by the passage of the leading end of the article therepast. The lever 44 is a one-shot actuator and only initiates the imprinting operation, a return switch being incorporated within the apparatus. With the invention herein provision is made to compensate for deviations in package height without changing the installed position of the apparatus.

The apparatus 10 comprises a housing 46 formed of a pair of mounting plates 48 and 50 which are arranged side by side, spaced apart and connected by transverse corner braces 52 and 54 seated in aligned apertures (not shown) formed in said plates 48 and 50 and secured thereto. Transparent plates 56 are installed on each plate 48 and 50 by screws 60 which may also secure the braces, 52,54. End wall 62 is secured in position between plates 48 and 50 by screws 64. Transverse brace 66 is secured between said plates 48 and 50 by screws 68 and bottom plate 70 is secured to the brace 66 by screw 72.

The inner surface 74 and 76 of plates 48 and 50 carry coextensive, aligned, matching, horizontally oriented, facing grooves 78 and 80 parallel and adjacent the upper edges 82 and 84 of said plates 48,50 and extending about two thirds of the total length of said edges. Grooves 74 and 76 open to end 86 of the respective plates 48 and 50 slidably to receive the edges of cover plate 88.

A pair of matching, facing, vertically oriented grooves 90 and 92 are formed in plate surfaces 74 and 76 opening to the upper edges 82 and 84 of said plates 48 and 50. The inking cartridge assembly 94 is received within the housing 46 in chamber 96 defined between the grooves 90 and 92 and the end wall 62 by sliding the assembly 94 in grooves 90 and 92 until the inking cartridge assembly 94 seats on facing stop pins 98 set into said plate surfaces 74 and 76.

The inking cartridge assembly 94 comprises a holding frame 100, a sponge-like rectangular gasket 102 and an ink storing container 104, which is pre-inked and is commercially available. Gasket 102 is formed of spongy material such as a closed-cell foam rubber or the like. A thin layer formed of ink impervious rubber-like sheet material can be adhered to gasket 102, if desired. The container 104 comprises a plastic molded, thin-walled, somewhat resilient box 106 having an entrance 110 and an outer rim 112 coextensive with said entrance 110 and surrounding same and an inner rim (not shown).

An ink-saturated pad 114 is disposed within the interior of the box 106, preferably fully occupying the interior. A thin sheet liner preferably of plastic material, is included across the top of the box to shield and seal off the entrance 110 preventing access to the interior pad 114 until assembly thereof into the cartridge unit 94 is desired. The liner 108 usually is provided with a scored area, removal of which defines a window to enable access to be gained to said ink-saturated pad surface but leaving a bordering position between the inner rim and the ink-saturated pad 114. The window may be of rectangular, circular or even ovular configuration, depending upon the perimetric configuration of the imprint to be applied to the surface 43 of article 16 or the overall size and/or configuration of the particular configuration, if the surface 43 would comprise a bottle cap or the like (not shown), and is adapted to form a direct sealed engagement with the gasket on the type holder 170.

The gasket 102 is engaged upon the outer rim 112 of the container 104 and together, slidably are engaged within the frame 100 in the channel 122 defined by inner rim 124 and flanges 126 of said frame, as indicated by the broken line 128. The cartridge assembly 94 now is complete and ready for installation into chamber 96.

A holding structure 130 for retaining the cartridge assembly 94 in place within the chamber 96 is provided. The holding structure 130 comprises a plate member 132 of generally rectangular configuration carrying a central recess in which an aperture if formed. The plate 132 is smaller in area than the end wall 62 and is arranged parallel thereto. An elongate threaded bolt 134 is received through the aperture in plate 132. A washer (not shown) is placed at the free end (not shown) of bolt 134 and locked in place by lockwasher (not shown). A retaining nut 136 is seated on the bolt 134 at the opposite side of plate member 132.

The bolt 134 is threadably engaged through a passageway (not shown) formed in wall 62 and a retaining washer (not shown), including small diameter spacer ring (not shown), are engaged on said bolt 134. The head of the bolt 134 mounts a knob 138 including collar 146. Rotation of the knob 138 will cause the plate to be moved away from the grooves 90 and 92, widening the space between the imprinting head and the plate 132 whereby the inking cartridge assembly 94 can be installed. Once the said inking cartridge assembly 94 has been installed, the plate member 132 can be brought to bear against the container 104. The rotatable wheel 142 seated on threaded bolt 134 between the collar 146 and the wall 62 functions to limit the extent of movement of the said plate member 132. Plate member 132 can be moved, translated by the manipulation of the knob 138, to facilitate the removal of a spent or exhausted cartridge assembly 94 and in particular, the replacement of an exhausted container 104 with a fresh replacement container.

Attention now will be directed to the imprinting head, designated generally by reference character 150 which is disposed within the housing 46 for movement in an imprinting stroke and a return stroke between a pair of angularly displaced positions, namely, a rest position, whereat a sealed engagement with the ink saturated pad of the inking cartridge assembly 94 is established and an imprinting position along an arcuate path 90° offset from the rest position.

The imprinting device 150 as a unit comprises an elongate body 152 of generally rectangular configuration having an enlarged head portion 154 with an outwardly opening cavity 156 formed therein. The body 152 is provided with a through passage 158 for receiving shaft 160 therein to journal said body. A pair of parallel passageways 162 are formed through the enlarged head 154 opening to the cavity 156.

Cap bolts 164 carry compression coil springs 166 and are seated in said passageways 162 and terminate secured in a T-bar (not shown). The dimensions of the passageways 162 and the bolts 164 are selected to permit free movement of the bolts 164 in said passageways while limiting the coil springs' 166 disposition between the caps of bolts 164 and the enlarged head 154. The T-bar normally is seated within the cavity 156 next adjacent the opening thereof.

Type holder generally at 170 is formed of a generally rectangular hollow block 172 having a rectangular secondary cavity 174.

A base-lock type segments 176 are seated within the cavity 174 of the type holder 170 and carries mounted therein, type font elements 178. A resilient sealing gasket 180 is adhesively or otherwise secured tightly on the rim 182 of the type holder 170 coextensive with the cavity 174 thereof. The thickness of said gasket 180 is selected to be only slightly less than the outermost extent of the type font elements 178 when they are seated. The gasket 180 serves multiple functions, namely, to cushion the shock of impact between the imprinting head 154 and the liner 108 bordering the ink-saturated pad 114. Gasket 180 also functions to cushion the shock of impact between the imprinting head 154 and the surface 43 of the article 16 when imprinting is performed at the end of the imprinting stroke.

When the type font is to be changed or when the orientation of the message also is desired to be changed for different packaging applications, provision is made for facilitating access to the type holder 170, and in particular for removing the type holder 170 or changing its orientation, reassembling the type holder 170 to the imprinting head 154. The springs 166 are compressed by manipulation of the caps of bolts 164 toward the enlarged head 162. The caps are urged against the bias of said springs 166 until the holder 170 is forced outward of the cavity 174 sufficiently to be disengaged from the imprinting head.

Attention now is directed to the drive linkage and the cam and follower means cooperating effectively to translate the imprinting head 150 between the angularly spaced positions with constant angular accelleration to a maximum at midpath and decelleration, also constant to a terminal condition at the end of the imprinting stroke, the inertial extension thereafter effecting the printing impression. The drive linkage comprises a pair of link members 190 and 192, each having shallow arms 194. Arms 194 carry through passageways 196. Links 190, 192 are journalled on shaft 198 mounted in passageway 196 and through a bore taken through head 150.

The head 154 has a pair of extensions 200 and passageways 202 are formed therein. Shaft 204 is journalled in said passageway, 202 and roller bearings (bushings) 206 are seated securely at the opposite ends of the shaft 204. A cam slot 210 is formed in each plate 48 and 50.

The cam slots 210 are identical, coextensive and aligned along their length when the plates 48,50 are assembled to form the side parts of the housing 46. The cam roller bushings 206 are seated within the cam slots 210. The cam slots 210 are formed so that they guide the bushings 206 during the imprinting and return strokes, and hence the imprinting head 150 through a rotation of 90° with minimum possible contact on the cam face and with the load divided equally across its entire face.

The width of the slots 210 increases slightly at the corners 212, that is approximate the midpath of travel, over a generally constant width over the remaining portions to avoid possible binding due to manufacturing variations in the dimensions of the pertinent elements.

The path of the cam slot is developed so as to effect a constant angular accelleration of the imprinting head during the imprinting stroke from the load condition to the midpath, engaged with the cartridge and a constant decelleration from the midpath to the terminus of the imprinting stroke. At the load condition, the imprinting head is arranged with the face of the type holder in a vertically oriented plane. At the terminus of the imprinting stroke, the type face is in a horizontally oriented condition.

The minimization of the rate of rotation of the imprinting head near the ends of the stroke effectively prevents shaking and/or misalignment at the ends of the stroke.

In the course of its travel, the imprinting head is rotated 90°, the angle defined between the center line of link 190 and the center line of the imprinting head, that is the pivot axis of said head, is between 90° and 180°. From 0° to 9°, the change of the latter angle is 1° for each degree of rotation of the link, the angular rotation is constant and the initial acceleration, zero.

From 9° to and through 45°, the motion of the imprinting head is such as to obtain a gentle constant angular accelleration of the head with least (minimization of) thrust or wear on the cam surface. The link moves through 45° rotation to the midpath (midpoint of the cam slot) while the angular rotation of the head is directed through 90° relative to the link.

The same path for decelleration is followed through the remaining 36° of movement of the link to the final 9° of the travel during which the imprinting head again assumes a parallelogrammic motion. The parallelogrammic motion insures that the plane of the type face will be parallel to the impact surfaces during its final approach thereto.

In the referenced co-pending application imprinting head is urged through its path during the imprinting stroke so that its least angular rate of rotation occurs at midpath to avoid undesired fold-over at the midpath. With the herein path, fold over has been eliminated as a problem. With the invention, the least rate of rotation occurs at the end of said strokes (imprinting and return).

The path defined by the cam slot 210 is extended at its theoretical ends to provide for an additional angular movement of the link 5° at the opposite ends of the imprinting stroke and return stroke to insure that the cam roller will not strike the ends of the path.

This also enables adjustment of the length of the stroke ±3/32nds as will be explained hereinafter. The angular rotational accelleration of the imprinting head increases to a peak at the midpoint and then decelleration occurs through the remaining 36° until the 81° to 90° generally straight section is reached.

Links 190, 192 have enlarged end portions 214 through which there are pivot assemblies 216 and 218 with the axes of assembly 216 being generally parallel to passageways 196. Shaft 220 is mounted in pivot assembly 216.

The second pivot assembly 218 is positioned parallel to first pivot assembly 216. Pivot assemblies 216,218 include bearings carried by the housing plates 48,50. The shaft 220 is maintained in fixed relationship relative the pivot assemblies. Means are provided to fix the spacing between enlarged end portions 214 and to center the linkage assembly and imprinting head 150 between said plates 48,50.

Shaft 220 is coupled pivotally to plunger 222 of cylinder 224 and is secured by a nut (not shown).

There is a little "play" or looseness provided in the accommodation of said shafts through the respective bushings seated in the respective passageways as related so as to reduce the likelihood of binding during the operation of the apparatus 10.

The drive mechanism for the apparatus 10 is designated generally by reference character 230 and includes a fluid pressure operated cylinder 224 and the plunger 222 movable between fully withdrawn and fully extended conditions within said cylinder 224, a four-way valve 234 coupled between the cylinder 224 and the source of pressurized fluid (not shown). The cylinder 224 is mounted fixedly to a rockable plate 236 provided with ears 238 and a depending flange 240. The threaded end 242 of the cylinder 224 is secured to the depending flange 240 of said plate 236.

The four way valve 234 is seated interior of the housing 46 adjacent the bottom plate 70 and is secured to the transverse bottom brace 66. The valve body 244 of valve 234 is arranged generally parallel 1 and below, the cylinder 224. Valve 234 is coupled to a source of fluid pressure (not shown) by tubing 246 secured to fitting 248. The tubing 250 couples the cylinder 224 to one port 252 of the valve 234 by securement to the fitting 254 of said cylinder 224. The fitting 254 is coupled to another port of valve 234. Ball switch 256 is disposed at an end of the valve 234 opposite the fitting 248.

Figure 4:
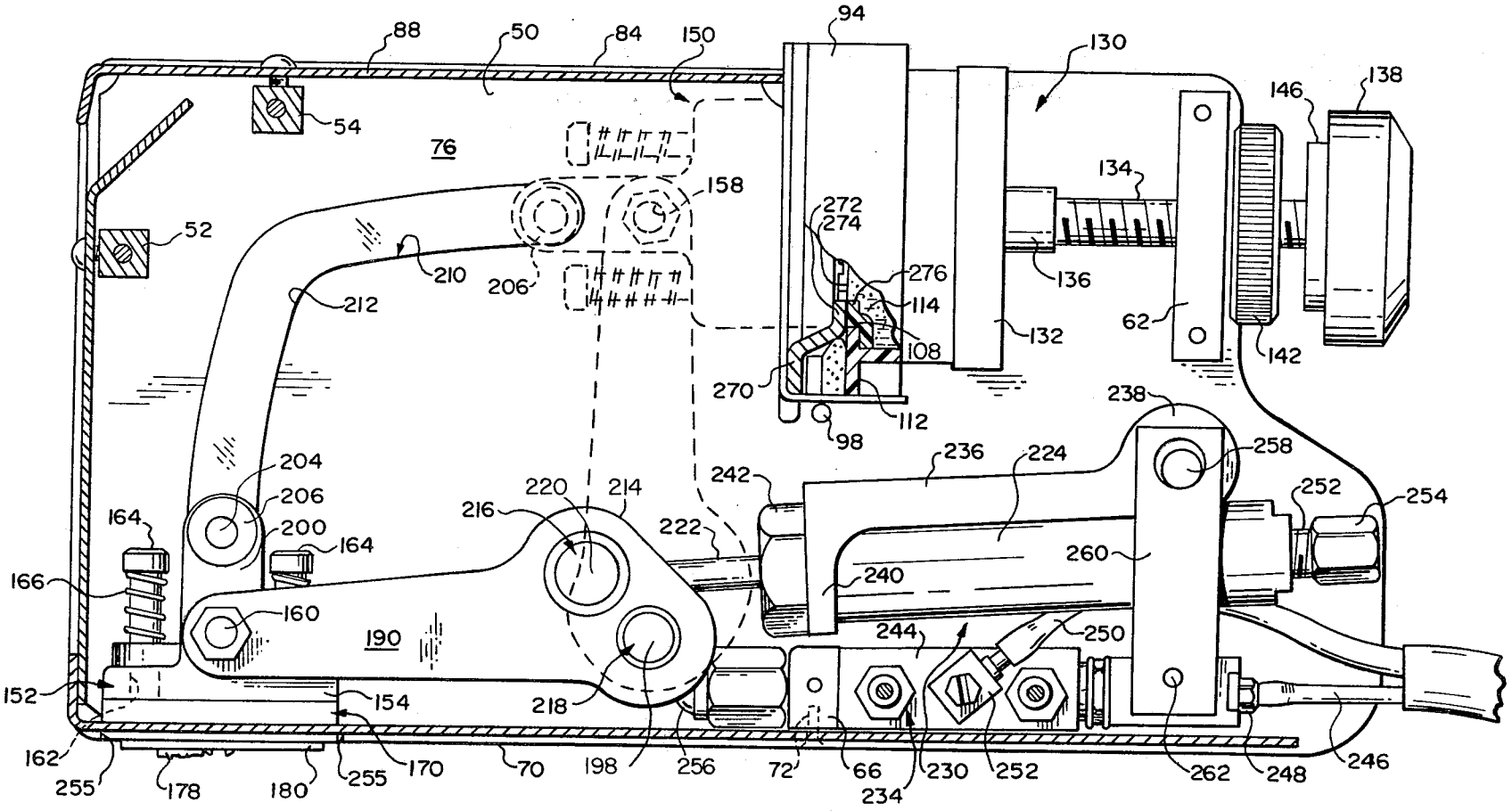
FIG. 4 is an enlarged elevational view of the imprinting apparatus of FIG. 1 with portions deleted and shown partially in section, to show interior details.

In FIG. 4, the ball switch 256 is illustrated in the condition assumed when the imprinting head 150 is at the terminus of its imprinting stroke. As the plunger 222 is driven out of the cylinder 224, the drive links 190,192 (in broken line) is caused to pivot about the axis of shaft 198 through a part of the imprinting stroke until the imprinting head 150 is in the condition represented by the full representation.

Figure 3:
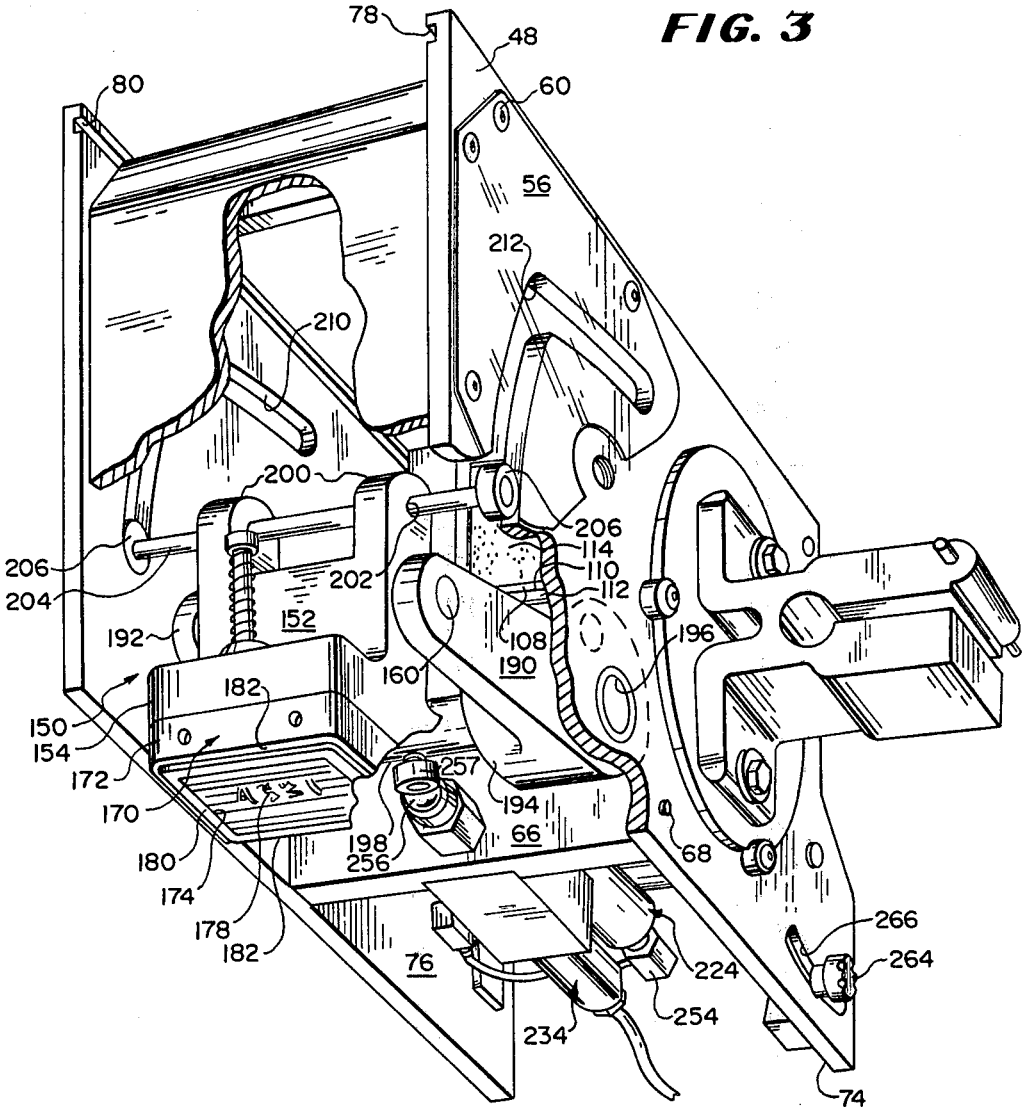
FIG. 3 is a bottom perspective view of the imprinting apparatus illustrated in FIG. 2, portions of same being deleted to show interior detail.

Referring to FIGS. 1 and 3, the actuating lever 44 disposed in the path of the article 16 is tripped by the leading end of said article 16. The interception of the article 16 by the actuating lever 44 operates the valve 234 to cause fluid pressure to be introduced into the cylinder 224 driving the plunger 222 outward of the cylinder 224. As the plunger 222 is forced outward of the cylinder 224, the imprinting head 150 is pivoted about shaft 198 directing the head 150 along a path represented by an arc. As the bearings 206 carried by the shaft 204 are driven further along the cam slot 210 toward the midpath point of the imprinting stroke, the imprinting head reaches its maximum angular speed of rotation and whips around the corner 212 directing the orientation of type holder 170 to approach a horizontal plane parallel to the surface of the package to be imprinted. After passing the midpath of the imprinting stroke guided by the cam slot 210, the head 150 decellerates angularly until stopped at the end of the said stroke. The type holder 170 is extended inertially to imprint the package surface.

The window 255 in bottom plate 70 has dimensions slightly larger than that of the type holder 170 so that the imprinting head will be directed, during imprinting, through the window 255 and will impact upon said surface 43. The parallelogrammic motion of the type holder 170 in the last portion of the imprinting stroke enables the inked type 178 carried by the type holder 170 effectively to kiss the surface 43 of the article 16 whereby not to damage same or to mis-hit same orientationally. The resilient gasket 180 on the type holder 170 absorbs the shock of engagement with the surface 43 and also functions to further enable the orientation of the type holder 170 to be self-adjusted so as to compensate for minor surface irregularities as well as to compensate for very minor height differences so long as the surface to be imprinted is disposed spaced from the imprinting head within the range of extension of said type font 178 carried by the type holder 170, inertially or when extended adjustably as will be explained later.

As the shaft 198 rotates, the bolt 257 carried thereby rotates sufficiently to signal the end of the one-shot imprinting cycle by impinging upon the ball switch 256 when the imprinting head 150 has delivered the imprinting via type holder 170 and type font 178. Striking of the ball switch 256 initiates a return movement of the plunger 222 and hence initiates the return stroke to bring the imprinting head 150, and particularly, the type holder 170, back to its sealed relationship with the cartridge assembly 94. The exposure of the pad 114 is minimal. As viewed in FIG. 1 it is evident that the imprinting apparatus can be installed at a predetermined location relative to the conveyor and is adjustable for height and overhang, can be installed on either side of the conveyor within appreciable downtime, and can be rotated through any angular disposition relative to the conveyor.

The invention herein provides for a vernier type adjustment of the imprinting location by varying the terminal location of the imprinting stroke. This is accomplished pivotally by mounting the rocker plate 236 on an eccentric axis 258. The vertically offset point of the said eccentric mounting axis is variable to vary the terminus location a predetermined linear distance, here ±3/32nds of an inch. The adjustability compensates for variance in the normally encountered height once the imprinting apparatus has been mounted set up without disassembly. The variance of height of a series of packages being processed require compensation which can be adjusted manually by the operator without requiring such adjustment to be made in the mounting per se.

A plate 260 carries the eccentrically centered shaft which constitutes said axis 258. Plate 260 carries pin 262 which is secured to adjustment knob 264. Through arcuate slot 268 the pin 262 is guided for movement in arcuate slot 266 formed in plate 48 along an angular path. (See arrow FIG. 3). Movement of the pin 262 in slot 266 causes the plate 236 to be shifted horizontally thus varying the extent of the imprinting and return stroke terminal with the said linear horizontal movement of said plate 236. The apparatus is versatile, more durable than prior imprinting devices of the intermittent impact type, enables longer useful life for the inking cartridges in view of the improved sealing effect obtained. Selective hyper-extension of the type-holder can be provided for gaining access to the type holder 170 for removal and/or replacement thereof, as well as to change its orientation without the use of tools.

The invention is not limited to the use of only fluid operated systems such as described above. Electrically operated devices such as solenoids can be employed to drive the plunger or the linkages to move the imprinting head between its rest and imprinting positions. No means to intercept the imprinting head during either imprinting or return stroke need be provided. The desired path defined by the cam slot is sufficient to enable the desired orientation of the type holder to be reached at the imprinting location and at the terminus of the return stroke.

No precautions need be taken to prevent misfolding of any linkages causing misalignment of the imprinting head or other interference with the desired path of said head during the imprinting and/or return strokes. The actuating lever 44 may be replaced by electronically operated sensing means, for example, such as a proximity detector, a photocell, etc. which is activated by the presence of an article at or coming to the imprinting location.

Figure 2:
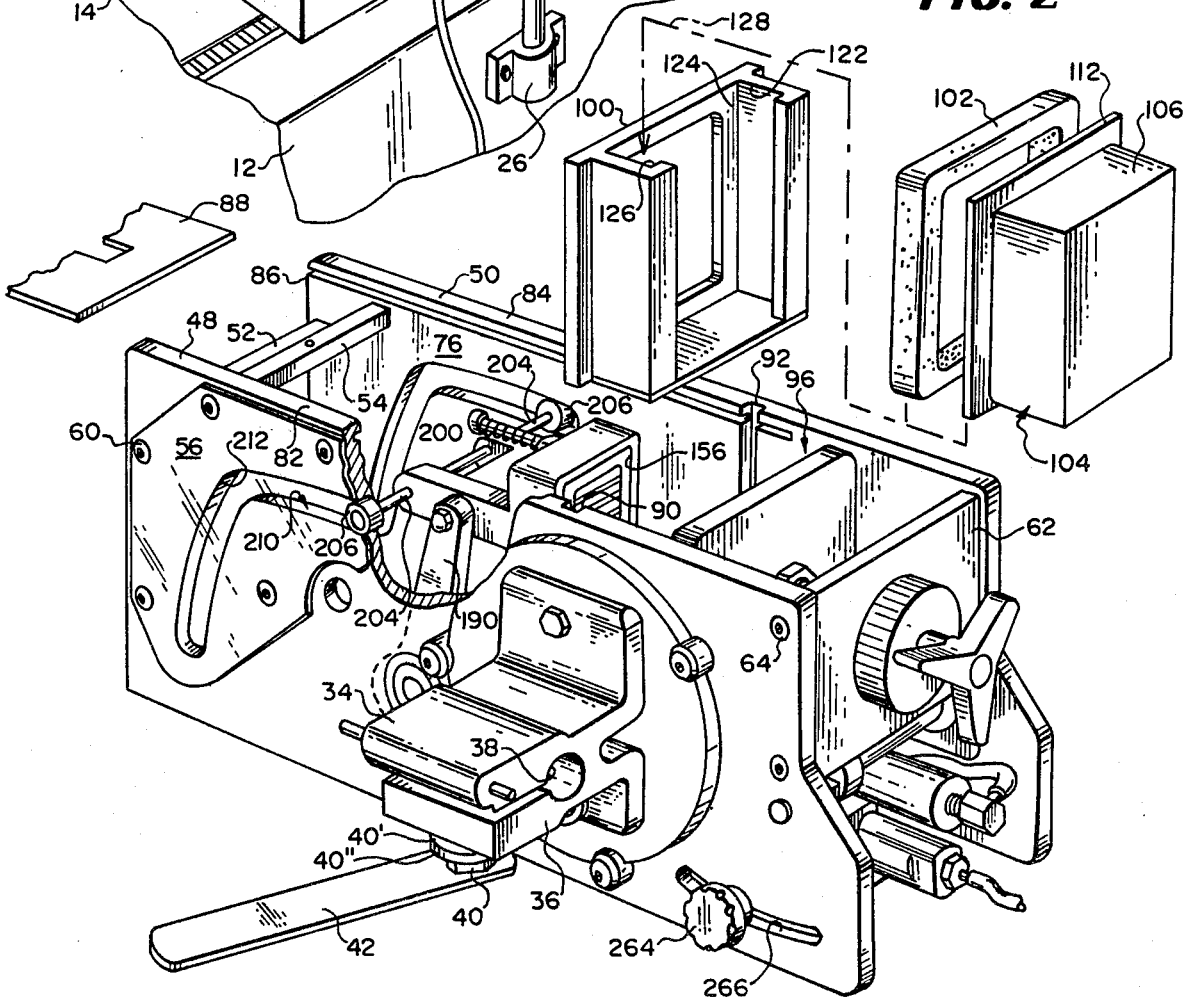
FIG. 2 is an exploded top perspective view of the article imprinting apparatus illustrated in FIG. 1 shown disassembled from the conveyor and in the process of being loaded with an inking cartridge, portions of the apparatus being broken away to show interior detail.

It should be pointed out that although not shown in FIG. 2, reference is to be made to FIG. 4 wherein there is illustrated the thin plate or mask 270 of generally rectangular dish-shaped configuration installed along with the cartridge assembly 94 functioning as supplementary sealing means for establishing a sealed engagement between the imprinting head and the ink saturated pad 114 of the cartridge 94.

Mask 270 carried a central recessed floor and a window 274 is formed in the recessed floor, leaving inwardly directed rim portion 272. The mask 270 is seated on the frame holder 100 with the rim portion 272 engaged on the liner portion 108 closely adjacent the ink-saturated pad 114 and coextensively aligned with the window 276 of the liner 108. The mask 270 is fitted on the cartridge assembly 94 effectively as a part thereof and both are introduced in the holder 100 simultaneously.

Variations may be made in the details of construction, size, etc., embodying the invention without departing from the spirit and scope thereof as defined in the appended claims.

What I claim is:

1. In an article imprinting apparatus which includes imprinting head means carrying type font means for applying an imprint to the surface of an object, inking cartridge means having an exposed inking surface adapted to be engaged by said type font means during a rest condition whereat a sealed engagement is established between the imprinting head means and the inking cartridge means, drive means for translating said imprinting head means in an imprinting stroke and a return stroke between the rest condition and an imprinting position angularly disposed from said inking cartridge means through a path encompassing approximately ninety degrees of arc, and linkage means including a drive link pivotally mounted at one end to a stationary pivot point and at the opposite end to a movable pivot point, and a drive plunger for actuating said drive link, said imprinting head means being coupled to the movable pivot point whereby to effect the translation and guide means for controlling the rotation of said imprinting head means about the movable pivot point, said imprinting head means being rotated simultaneously with the translation thereof along said path, the improvement comprising said guide means comprising cam and follower means, said follower means being pivotally mounted to said imprinting head means at a location off set from the movable pivot point and movable therewith during translation of the imprinting head means, said imprinting head means being rotatable about the movable pivot point at a constant rotational acceleration relative to the drive link as said imprinting head means is translated along the length of said arc, the rate of change of rotational velocity of the imprinting head means per degree of rotation of the drive link being uniformly accelerated, the velocity of rotation of the imprinting head means being uniform at the locations proximate the ends of said path with the velocity of rotation increasing in accordance with the uniform rotational acceleration to the midpath of the strokes and decreasing under uniform deceleration to a location proximate the end of the path.

2. The imprinting apparatus as claimed in claim 1 in which said cam means comprises slot means defining a path for effecting the constant rotational accelleration of said imprinting head means and said follower means comprises shaft means carried by said imprinting head means and bushing means mounted on said shaft means and seated within said slot means, the initial rate of rotation and the terminal rate of rotation during translation of the imprinting head means results from following a path which defines a parallelogram.

3. The article imprinting apparatus as claimed in claim 1 and said imprinting head means include a type holder and means coupled to the type holder to permit limited inertial extension of the type holder upon the imprinting means reaching the limit of at least the imprinting stroke.

4. The article imprinting apparatus as claimed in claim 1 and eccentric mounting means for pivotally mounting said drive means on an eccentric axis and means for selectively shifting the degree of eccentricity of said last mentioned pivot mounting whereby controllably to shift the end points of the imprinting and return strokes during the operation of apparatus.

5. The article imprinting apparatus as claimed in claim 1 and means to stop the imprinting stroke of the imprinting head means at a location just prior to reaching of the imprinting position.

6. The article imprinting apparatus as claimed in claim 1 and eccentric mounting means for said drive means and means for shifting of the eccentric mounting axis linearly to change the end points of the imprinting and return strokes.

7. The article imprinting apparatus as claimed in claim 6 and a rockable plate, said plunger means mounted to said plate, means for pivotally mounting said rockable plate on the eccentric axis and means for selectively shifting the mounting axis of said rockable plate to shift the terminus of the said strokes during the operation of said apparatus.

8. The article imprinting apparatus as claimed in claim 1 and said imprinting head means include a type holder, and sealing mask means engaged over the exposed inking surface of the inking cartridge within the apparatus, said sealing means including inner linear means adapted to be engaged by said mask means and said type holder engaging said mask to establish and maintain said sealed engagement of the imprinting head means in the rest condition.

9. The article imprinting apparatus as claimed in claim 1 and sealing means engagable by said type holder to establish the sealed engagement with the inking cartridge within the apparatus.

* * * * *